US006932898B2

(12) United States Patent
Kryzman et al.

(10) Patent No.: US 6,932,898 B2
(45) Date of Patent: Aug. 23, 2005

(54) ELECTROCHEMICAL PROCESS FOR THE SIMULTANEOUS STRIPPING OF DIVERSE COATINGS FROM A METAL SUBSTRATE

(75) Inventors: Michael A. Kryzman, West Hartford, CT (US); Mark Jaworowski, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 318 days.

(21) Appl. No.: 10/268,337

(22) Filed: Oct. 9, 2002

(65) Prior Publication Data

US 2004/0069748 A1 Apr. 15, 2004

(51) Int. Cl.[7] ..... B01D 17/06; C25F 1/00
(52) U.S. Cl. ..... 205/717; 205/723
(58) Field of Search ..... 205/717–721, 205/723; 204/721

(56) References Cited

U.S. PATENT DOCUMENTS

| | | | | |
|---|---|---|---|---|
| 2,840,521 A | | 6/1958 | Wasserman | |
| 3,779,879 A | * | 12/1973 | Scott | 205/717 |
| 3,793,172 A | * | 2/1974 | Cadieux | 205/717 |
| 6,165,345 A | * | 12/2000 | Updegrove et al. | 205/717 |
| 6,176,999 B1 | * | 1/2001 | Jaworowski et al. | 205/717 |

FOREIGN PATENT DOCUMENTS

| | | |
|---|---|---|
| EP | 1 010 782 | 6/2000 |
| EP | 1 094 134 | 4/2001 |
| EP | 1 215 306 | 6/2002 |

* cited by examiner

*Primary Examiner*—Donald R. Valentine
(74) *Attorney, Agent, or Firm*—Bachman & LaPointe, P.C.

(57) ABSTRACT

An electrochemical process for simultaneously stripping diverse coatings from a metal substrate and, more particularly to the removal of MCrAlY and aluminide coatings from a base metal.

11 Claims, 2 Drawing Sheets

Combustor Float Wall Stripping in 5% (val.) HCl

ELECTROCHEMICAL PROCESS FOR THE SIMULTANEOUS STRIPPING OF DIVERSE COATINGS FROM A METAL SUBSTRATE

BACKGROUND OF THE INVENTION

The present invention relates to an electrochemical process for simultaneously stripping diverse coatings from a metal substrate and, more particularly to the removal of MCrAlY and aluminide coatings from a base metal.

Elements of gas turbine engines are protected from high oxidation and corrosion by coating the base metals with a protective coating. Gas turbine engine combustor float wall elements are protected from high temperature oxidation and corrosion with two types of coatings. The first coating is a coating of MCrAlY on the inside surface of a combustor float wall and an aluminide coating on the outside surface of the float wall. To date, the repair sequence for such elements requires the removal of coatings from the base metal. The current process involves separate stripping techniques for the two coatings. The MCrAlY coating is removed either by soaking the parts in a high concentrated hot hydrochloric acid solution or by water jet blasting. The aluminide coating is removed by stripping in nitric acid. These processes are difficult to control, are hazardous, and extremely labor intensive.

It is clear that indeed remains for an approved process for stripping diverse coatings from a metal substrate.

It is therefore the primary object of the present invention to provide such a process.

Other objects and advantages will appear hereinbelow.

SUMMARY OF THE INVENTION

In accordance with the present invention, the foregoing objects and advantages are readily obtained.

The process of the present invention allows for the simultaneous removal of at least two diverse coatings from the metal substrate. The metal substrate having the at least two diverse coatings is immersed in an electrolyte and then a potential is applied across the electrolyte at a magnitude sufficient to dissolve the at least two coatings and remove them form the metal substrate. The process is particularly useful for removing diverse coatings of M chrome aluminum yttrium MCrAlY (where capitol letter M is nickel and/or cobalt) and aluminide coatings from a metal substrate.

Further objects and advantages of the present invention will appear hereinbelow.

BRIEF DESCRIPTION OF THE DRAWINGS

A detailed description of preferred embodiments of the present invention follows, with reference to the attached drawings, wherein.

DETAILED DESCRIPTION

The present invention relates to an elctrochemical process for simultaneously stripping diverse coatings from the metal substrate and, more particularly, to the removal of MCrAlY (where M is nickel and/or cobalt) and aluminide coatings from a base metal.

In accordance with the present invention, the base metal is typically any alloy suitable for use in high temperature oxidation and corrosion environments. Suitable base metal alloys include stainless steel alloys, nickel base alloys cobalt base alloys and the like. The base metal substrate is provided with diverse coatings. In the particular high temperature oxidation and corrosion environments for which the base metals are employed, diverse coatings are often required. For example, in the case of combustor float walls used in gas turbine engines, the base metals are coated with a high temperature resistant metal coating and an aluminide coating. Typically, the inside surface of the metal substrate is coated with MCrAlY (where M is nickel and/or cobalt) the outside surface of the engine combustor float wall is coated with an aluminide coating.

It has been found in accordance with the process of the present invention that the diverse coatings on the metal substrate can be simultaneously removed by employing an electrochemical process for stripping the diverse coatings from the metal substrate. The metal substrate having at least two diverse coatings thereon is immersed in an electrolyte and a potential is applied across the electrolyte at sufficient magnitude to dissolve and remove the two diverse coatings from the metal substrate.

It has been found that a suitable electrolyte comprises an acid solution. Suitable acid solutions include hydrochloric acid, nitric acid and sulfuric acid. However, hydrochloric acid is preferred as it acts faster than either nitric acid or sulfuric acid. The preferred electrolyte comprises a 5 to 10 volume percent solution of hydrochloric acid.

In accordance with a preferred embodiment of the present invention, the electrolyte is agitated while applying the potential. In addition, the process is preferably carried out under ambient conditions. The potential applied in accordance with the present invention is greater than +50 mV and up to about +150 mV volts verses a Ag/AgCl reference electrode.

As noted above, the base metal substrate includes any high temperature corrosion resistant alloy including stainless steels, nickel base alloys, nickel and cobalt based alloys, and the like.

Figure 1A:
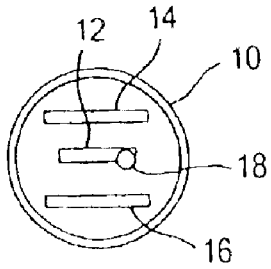
FIGS. 1*a, b* and *c* schematically illustrate a process in accordance with the present invention
Figure 1B:
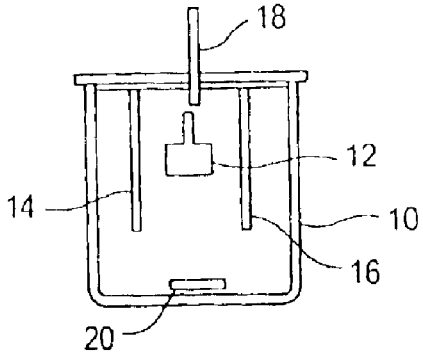
Figure 1C:
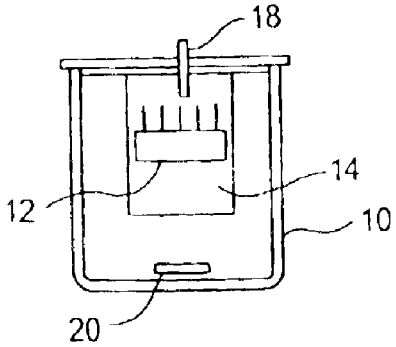
Figure 2:
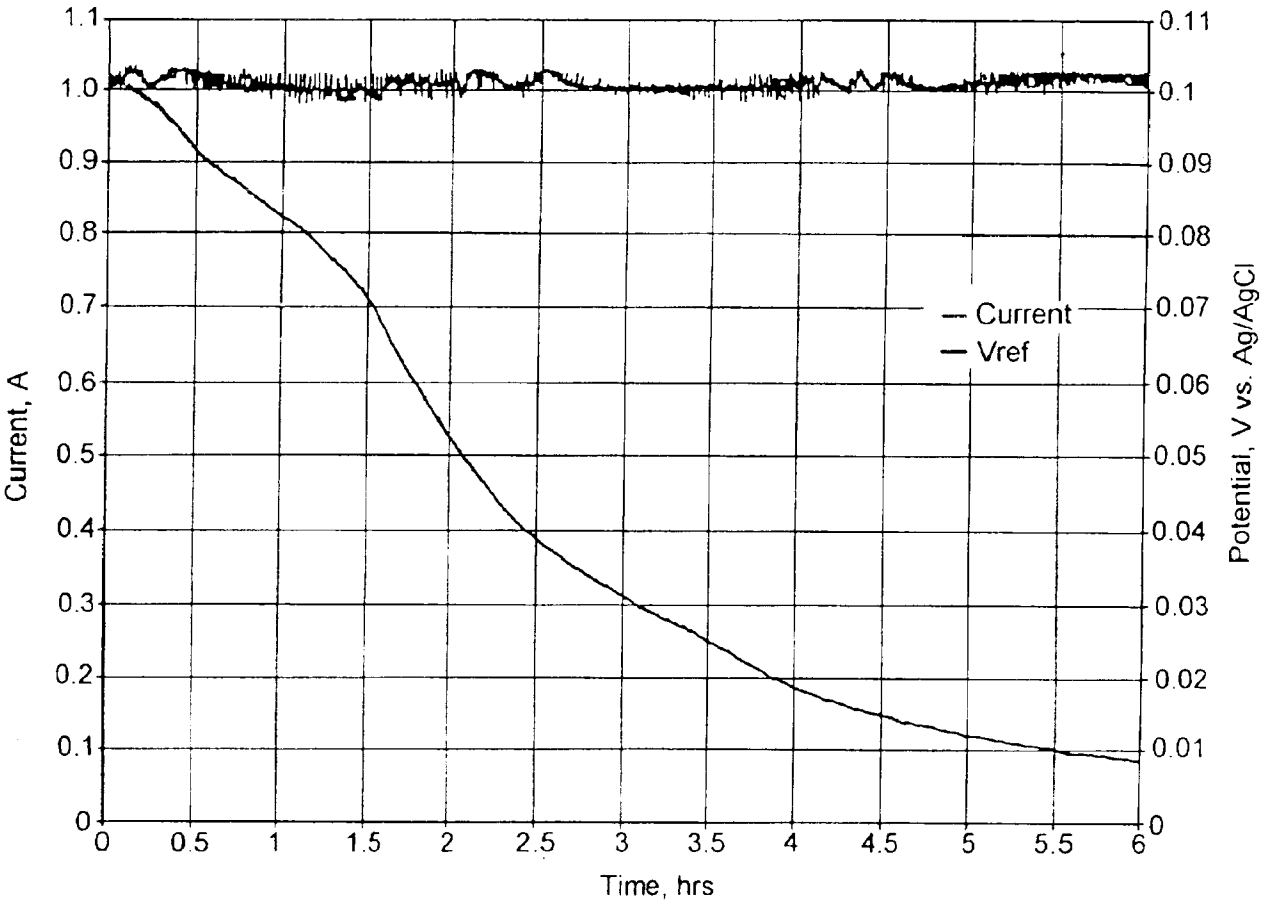
FIG. 2 illustrates an electrochemical record of the electrochemical process for the simultaneous stripping of diverse coatings in accordance with the present invention.

FIG. 1 schematically illustrates a process in accordance with the present invention. As shown in FIG. 1, a suitable vessel 10 is provided, and the diversely coated metal substrate element 12 to be treated as positioned therein. The element 12 is preferably positioned between cathodes 14, 16 which may advantageously be graphite cathodes or made of other materials with high corrosion resistance to mineral acids, e.g. Hastelloy C-22, and a reference electrode 18 is positioned extending into an electrolyte solution.

The element 12 may advantageously be suspended in the solution contained within the vessel 10, and structures used to suspend the element 12 should be selected from a material which will not be effected by the conditions in material within the vessel 10. For example, in accordance with the present invention, titanium wire is particularly suitable for securing element 12 as desired.

As set forth above, it may be desirable to agitate the electrolyte within the vessel 10 and this may be accomplished, for example, by using any suitable mixing or agitation devices would be readily known to a person skilled in the art.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for the simultaneous removal of at least two diverse coatings from a metal substrate comprising the steps of:

providing an element comprising a metal substrate having at least two diverse coatings thereon;

immersing the element in an electrolyte; and applying a potential across the electrolyte at a magnitude wherein the at least two coatings are dissolved and removed from the metal substrate.

2. A process according to claim 1 wherein the metal substrate is coated with MCrAlY on one surface (where M is selected from the group consisting of Ni, Co, and mixtures thereof) and aluminide on the other surface thereof.

3. A process according to claim 1 wherein the potential is greater than +50 mV and up to about +150 mV volts versus a Ag/AgCl reference electrode.

4. A process for the simultaneous removal of at least two diverse coatings from a metal substrate comprising the steps of:

providing an element comprising a metal substrate having at least two diverse coatings thereon, wherein the metal substrate is coated with MCrAlY on one surface (where M is selected from the group consisting of Ni, Co, and mixtures thereof) and aluminide on the other surface thereof;

immersing the element in an electrolyte; and applying a potential across the electrolyte wherein the potential is greater than +50 mV and up to about +150 mV volts versus a Ag/AgCl reference electrode and, wherein the at least two coatings are substantially simultaneously dissolved and removed from the metal substrate.

5. A process according to claim 1 or 4 wherein said electrolyte comprises an acid solution.

6. A process according to claim 5 wherein the acid solution is selected from the group consisting of hydrochloric acid solution, nitric acid solution, sulfuric acid solution and mixtures thereof.

7. A process according to claim 5 wherein the acid solution is a hydrochloric acid solution.

8. A process according to claim 7 the electrolyte comprises 5 to 10 volume % solution of hydrochloric acid.

9. A process according to claim 1 or 4 including agitating the electrolyte while applying the potential.

10. A process according to claim 1 or 4 including carrying out the process under ambient conditions.

11. A process according to claim 1 or 4 wherein the metal substrate is a metal alloy selected from the group consisting of stainless steel alloys, nickel alloys, cobalt alloys, and nickel-cobalt alloys.

* * * * *